US005522448A

United States Patent [19]

Righi

[11] Patent Number: 5,522,448

[45] Date of Patent: Jun. 4, 1996

[54] COOLING INSERT FOR CASTING MOLD AND ASSOCIATED METHOD

[75] Inventor: Jamal Righi, Murrysville, Pa.

[73] Assignee: Aluminum Company of America, Pittsburgh, Pa.

[21] Appl. No.: 313,343

[22] Filed: Sep. 27, 1994

[51] Int. Cl.[6] ..... B22D 27/04

[52] U.S. Cl. ..... 164/122; 164/348

[58] Field of Search ..... 164/348, 144, 164/118, 297, 122, 125, 128, 443; 165/168, 169, 109.1

[56] References Cited

U.S. PATENT DOCUMENTS

| | | | |
|---|---|---|---|
| 1,894,983 | 1/1933 | Eppensteiner | 164/348 |
| 3,667,248 | 6/1972 | Carlson | 62/225 |
| 3,903,956 | 9/1975 | Pekrol | 164/316 |
| 3,995,680 | 12/1976 | Diez | 164/348 |
| 4,062,399 | 12/1977 | Lirones | 164/338 |
| 4,162,700 | 7/1979 | Kahn | 164/154 |
| 4,175,725 | 11/1979 | Cattano | 249/81 |
| 4,356,858 | 11/1983 | Perrella et al. | 164/154 |
| 4,637,451 | 1/1987 | Perrella et al. | 164/342 |
| 4,640,337 | 2/1987 | Sevastakis | 164/443 |
| 4,655,280 | 4/1987 | Takahashi | 164/348 |
| 4,754,799 | 7/1988 | Robinson | 164/113 |
| 4,834,166 | 5/1989 | Nakano | 164/225 |
| 4,899,805 | 2/1990 | Iverson | 164/348 |
| 4,993,473 | 2/1991 | Newcomb | 164/63 |
| 5,213,149 | 5/1993 | Ruff et al. | 164/348 |

FOREIGN PATENT DOCUMENTS

| | | | |
|---|---|---|---|
| 57-142755 | 9/1982 | Japan | 164/348 |
| 7303901 | 9/1973 | Netherlands | 165/169 |

*Primary Examiner*—Jack W. Lavinder
*Assistant Examiner*—I.-H. Lin
*Attorney, Agent, or Firm*—Arnold B. Silverman; Thomas R. Trempus

[57] ABSTRACT

Apparatus for casting a metal article includes a mold having a mold insert provided by cooperating shell and insert core which defines a coolant flow passageway. The insert has a portion disposed adjacent to the mold cavity and, in a preferred embodiment, defines a portion of the mold cavity. The passageway portion disposed adjacent to the mold defining surface of the insert has turbulence inducing elements which establish turbulence of the coolant as it flows therethrough. In a preferred embodiment, the turbulence inducing elements consist of a plurality of generally parallel elongated ribs oriented generally perpendicular to the axial extent of the turbulence inducing portion of the coolant passageway. The apparatus is particularly advantageous for a die casting having thin wall portions disposed upstream in respect of the direction of metal flow from thick wall portions. A corresponding method is provided.

45 Claims, 8 Drawing Sheets

COOLING INSERT FOR CASTING MOLD AND ASSOCIATED METHOD

BACKGROUND OF THE INVENTION

1. Field of the Invention

This invention relates to an improved cooling insert for casting molds and an associated method and, more specifically, it relates to a highly efficient cooling system which resists undesirably high levels of shrinkage porosity in cast metal articles.

2. Description of the Prior Art

It has long been known to manufacture metal articles by die casting machines wherein a mold cavity defines the shape of the article to be molded and molten metal is introduced into the cavity through runners and gates. It has also been known in connection with such die casting systems to employ circular channels extending through the mold spaced from the mold cavity. A coolant liquid, such as oil or water would circulate in the channels to effect cooling of the molten metal in the desired manner. U.S. Pat. No. 3,667,248 discloses coolant passages within a mold and also discloses the use of a coolant probe.

One of the problems with traditional cooling techniques is that such cooling channels, which may have diameters on the order of about ⅝ inch, have a relatively low heat removal rate as the cooling surface areas are small and convective heat transfer rates are low. Ineffective cooling can result in undesired high levels of shrinkage porosity within the casting which, in turn, results in inferior mechanical properties in the cast article. The problem is particularly acute with respect to castings wherein a thickened wall portion is disposed downstream (with respect to the direction of metal flow) of a thinner wall portion such that the thin portion solidifies long before the thick portion thereby producing excess porosity in the thick wall portion of the casting as it cools. After the casting cavity is completely filled with molten metal, high intensification pressures which may be on the order of about 12,000 psi are applied to the metal to feed metal to the regions of shrinkage porosity. A problem arises when the casting has metal fed from the thin walls which solidify first as the thick wall does not have a direct feed of molten metal to compensate for its shrinkage in volume and, therefore, shrinkage cavities develop in the thick wall. There is a limit to how rapidly the isolated thick wall portions can be caused to freeze through high cooling rates to produce relatively small and distributed porosity in such isolated thick walls. U.S. Pat. No. 4,834,166 discloses the use of a cooling mechanism and heating mechanism within a mold assembly employed to make ceramic molds.

U.S. Pat. No. 4,062,399 discloses the use of a plug member as part of a chill plate employed in combination with a ceramic mold. U.S. Pat. No. 3,903,956 discloses the use of cooling water which passes through an insert block in a die casting machine. Standard round cooling channels are employed in the insert block.

It has been known to employ cooling means in mold inserts which function to define a portion of the mold cavity. See, for example, U.S. Pat. Nos. 4,162,700, 4,637,451, and 4,754,799.

U.S. Pat. No. 4,356,858 discloses die casting machines having water containing mold manifolds which have fingers projecting therefrom to provide water at elevated temperatures so as to preheat the die to operating temperature.

U.S. Pat. No. 4,993,473 discloses the use of generally cylindrical heat conductive chill members in the in-gates.

U.S. Pat. No. 4,899,805 discloses cooling of a die by providing a plurality of curved mold surfaces annularly about the circumference of the exterior of the mold defining member and cooperating curved septum surfaces so as to define curved flow conduits for coolant flow therebetween. Means are provided to facilitate removal of nucleate bubbles and means for breaking up the viscous sublayer of the coolant liquid adjacent to the heat exchange surface. The breaking up of the viscous sublayer is said to be achieved by providing roughening projections ranging in dimension from about 0.3 times the thickness of the viscous sublayer to about twice the thickness of the viscous sublayer and transition zone. It also discloses placing micro-cavities in the heat exchange surface to promote efficient nucleate boiling. The micro-cavities have dimensions on the order of $10^{-4}$ to $10^{-2}$ mm.

In spite of the foregoing disclosures, there remains a very real and substantial need for a die casting mold and associated method which will efficiently cool portions of the mold so as to eliminate excessive porosity in the molded article. This problem is particularly acute with respect to thicker wall portions which are disposed downstream in respect of the direction of metal flow from thinner wall portions which will tend to solidify earlier, thereby obstructing further interdendritic flow of the molten metal to the thicker wall portions during solidification.

SUMMARY OF THE INVENTION

The present invention has met the above-described need by providing a die casting mold which has a mold cavity and a coolant receiving insert disposed within the die casting mold having a portion adjacent to the mold cavity and, in a preferred embodiment, defining a portion of the mold cavity. The insert has a passageway for flow of coolant therethrough with a portion of the passageway having coolant turbulence inducing means. The coolant turbulence inducing means may take the form of ribs, fins, or other mechanical means which will structurally disrupt the laminar flow of the coolant. The turbulent creating portion of the passageway is preferably disposed closely adjacent and parallel to the insert surface which faces and, in some embodiments, defines a portion of the mold cavity.

The insert preferably has an outer shell portion and a core portion with the shell portion having turbulence inducing means within the turbulent flow portion of the passageway. In one embodiment, the turbulence inducing means may consist of a plurality of generally parallel elongated ribs oriented generally perpendicular to the axis of the turbulent flow portion of the coolant passageway. In one embodiment where ribs are provided on both the upper and lower portions of the turbulent flow portion, it is preferred that the ribs be generally aligned with each other so as to create alternate zones of restriction and expansion as the coolant flows in an axial direction through that portion of the coolant passageway. In another embodiment, the ribs of the shell and the ribs of the core portions are in relative staggered position so as to create a meandering turbulent flow field.

The method of the present invention involves providing a die casting mold having a mold cavity and a coolant receiving insert disposed within the die casting mold. The insert has a coolant flow passageway with a portion adjacent to the mold cavity having coolant turbulence inducing means disposed therein. Molten metal is introduced into the die cavity and coolant flow is established within the insert passageway. Creating turbulence in the coolant flow within the insert portion adjacent to the cavity resists formation of undesired porosity in the section of the cast metal article that is adjacent to the insert by effecting rapid cooling.

In a preferred practice of the invention, the turbulent flow of coolant, created by the turbulence inducing means, enhances the heat transfer rate. The physical disruption of coolant flow by the turbulence inducing means creates flow tripping which creates separation of coolant from the insert wall followed by reattachment of the coolant thereto. This sequence of coolant flow resists formation of an undesired viscous sublayer on the insert passageway wall. This coolant flow sweeps vapor bubbles formed at nucleation sites away from the passageway heat exchanger surfaces and into the bulk fluid for removal from the insert, thereby resisting the undesired formation of a vapor film on the heat exchanger surface. Such a vapor film would interfere with efficient heat transfer between the insert surface and the circulating coolant. In embodiments wherein ribs are the turbulence inducing means, the ribs serve to establish the tripping action in the cooling stream.

It is an object of the present invention to provide a die casting mold, a cooling insert therefor and an associated method which will resist porosity defects in metal castings due to shrinkage which occurs with metal solidification.

It is a further object of the present invention to provide such a system wherein insert means within the die may serve to define a portion of the die cavity.

It is another object of the present invention to provide such a system wherein turbulence inducing means are disposed within the die insert closely adjacent to the insert coolant passageway portion which is disposed adjacent to the die cavity.

It is a further object of the present invention to provide such a die casting system which will rapidly cool thicker portions of the die cast article so as to reduce cycle time and increase productivity.

It is a further object of the present invention to provide apparatus and a method for casting metal articles which exhibit little or no detectable porosity through X-ray examination.

It is yet another object of the present invention to enhance the heat transfer area provided within a die insert and to increase the convective heat transfer coefficient.

It is yet another object of the present invention to provide such a system which facilitates localized, directional solidification of the too ken metal within the die cavity.

It is yet another object of the invention to effect rapid freezing of the thick wall sections in castings having walls of different thickness in order to resist coalescing of the pores into larger shrinkage cavities.

These and other objects of the invention will be more fully understood from the following description of the invention with reference to the illustrations appended hereto.

DESCRIPTION OF THE PREFERRED EMBODIMENT

While for convenience of reference herein, emphasis will be placed on a preferred use of the system of the present invention in casting metals by die casting, the invention is not so limited. For example, the invention may be employed in casting metal by low pressure, permanent mold casting, squeeze casting, semi-solid metal casting and other casting processes. The use of the expression "die" or "mold" herein shall be deemed to embrace all such practices.

The present invention substantially reduces x-ray detectable solidification porosity defects in metal castings, such as die castings, resulting from shrinkage upon solidification of the metal. This is accomplished by employing localized directional solidification so as to effect rapid cooling. While the invention is not so limited, it is particularly advantageous in respect of the casting of "complex parts" which have both thick and thin walled portions and have the thin wall portion disposed between the gate through which molten metal is introduced and the thick section as the thin section will tend to solidify before the thick section has adequately intensified with interdendritic alloy that could otherwise feed its shrinkage cavities.

Figure 1:
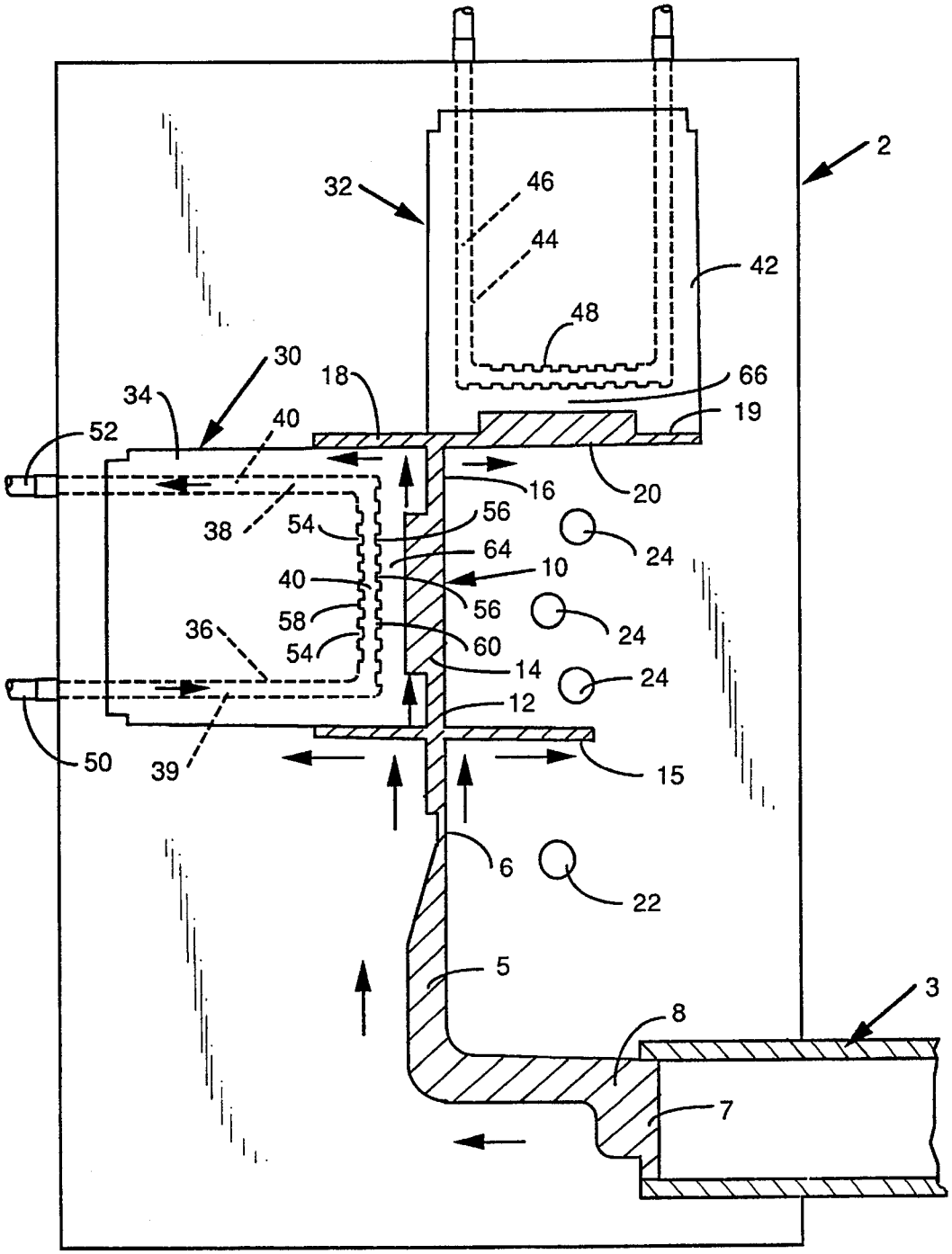
FIG. 1 is a partially schematic cross-sectional illustration of one embodiment showing a casting die including multiple inserts of the present invention.

Referring to FIG. 1, there is shown a die 2. Molten metal is fed through a shot sleeve 3, runner 5, and gate 6. A biscuit 7 and sprue 8 are residual metal parts which are to be separated from the cast part 10. The cast metal pan 10, in the form shown, has a thin wall 12 interposed between gate 6 and thick wall 14. A flange 15 emerges on both sides from thin wall 12 and is thinner than thin wall 12. Downstream in the direction of metal flow from thick wall 10 are second thin wall 16 which has the same thickness as thin wall 12. At the remote end of casting 10, a flange has thin wall portions 18, 19, and an interposed thick wall portion 20. It will be appreciated that thick wall 14 is downstream with respect to the direction of metal flow from thin wall 12 and thick wall 20 is downstream from walls 12, 16 and 18. As molten metal flows in the direction indicated by the arrows, solidification in wall 12 is likely to occur before full solidification in walls 14, 20 if conventional cooling techniques, such as the use of cooling channels 22, 24 were relied upon as the sole means for withdrawing heat from the molten metal in the mold cavity. As a result, upon cooling at a reduced rate, the thick walls 14, 20 would shrink and would have undesirably high porosity which could produce substantial defects in mechanical properties of the casting, such as ultimate tensile strength, yield strength and elongation, for example.

In the embodiment of the invention shown in FIG. 1, two heat exchanger inserts 30, 32 are employed. Cooling insert 30 serves to define a portion of the mold cavity which includes thick wall 14 and portions of thin walls 12, 16 with the primary cooling being provided adjacent to thick wall 14. Similarly, heat exchanger insert 32 defines a portion of the mold cavity adjacent to thick wall 20 and including portions of thin wag 18, 19. Heat exchanger insert 30, in the form shown, is defined by a shell 34 which is secured to an insert core 36 to define a coolant flow passageway 38 therebetween. The coolant flow passageway 38 has an entry portion 39, a discharge portion, and an interposed turbulence inducing portion 40 which will be described in greater detail hereinafter. Similarly, heat exchanger insert 32 has a shell 42 secured to an insert core 44 with a coolant flow passageway 46 having a turbulence inducing portion 48.

It will be appreciated that in this embodiment of the invention, the use of two heat exchanger or cooling inserts facilitates effecting the desired cooling at two locations within the mold cavity. The invention, depending upon particular needs, may also be employed with one cooling insert or three or more cooling inserts.

Inlet tube 50 is connected to a suitable source of coolant (not shown) and outlet tube 52 is connected to a coolant reservoir from which the coolant may be recycled after effecting a suitable reduction in temperature by any desired conventional means. Within the turbulence inducing portion 40 of the insert 30, are turbulence inducing means 54. In the form of the invention illustrated in FIG. 1, the turbulence inducing means 54, 56 are a plurality of elongated ribs extending generally transversely to the direction of flow of coolant through turbulence inducing portion 40. The ribs 54, 56 are alternated, respectively, with valleys 58, 60. As a coolant, such as water, oil, or a water-alcohol combination, for example, enters the turbulence inducing zone 40, the coolant stream will be broken up into substreams to thereby facilitate more efficient withdrawal of heat from the die cavity through insert walls 64, 66.

Figure 2:
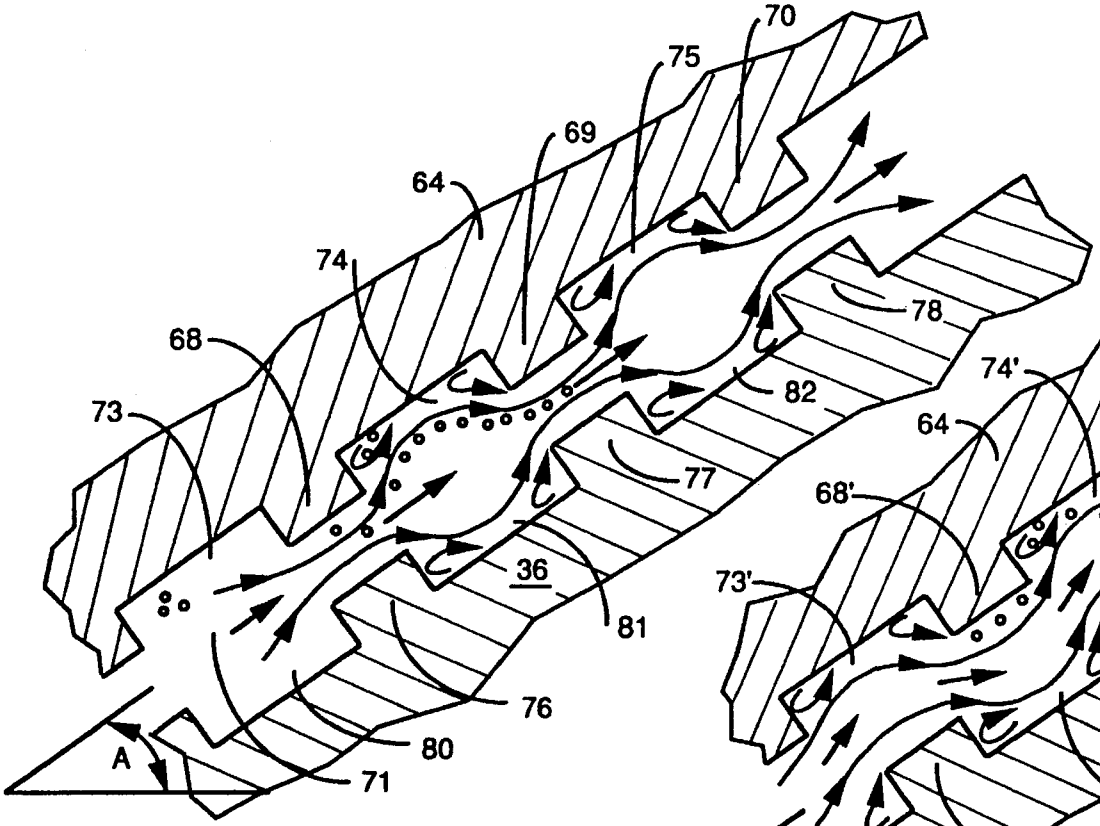
FIG. 2 is a fragmentary cross-sectional view of a form of coolant passageway of the present invention.

Referring in greater detail to FIG. 2, there is shown an embodiment wherein the ribs function as turbulent generating means. The shell wall 64 has a plurality of ribs 68, 69, 70 projecting into the turbulence inducing portion 36 of the coolant flow passageway 71. The ribs are oriented, as shown, generally transverse with respect to the direction of metal flow within the mold cavity. The ribs have interposed valleys 73, 74, 75. Similarly, ribs 76, 77 and 78, which are formed on the core insert 36, have adjacent valleys 80, 81, 82. In this embodiment, the ribs 68, 69, 70 and additional ribs (not shown) of the shell are in alignment with the ribs 76, 77, 78 with the ribs of the insert core. The path of cooling flow is represented by the lines containing arrows. It will be noted that eddy streams are created within the comers of the valleys. These streams serve to resist undesired formation of a boundary layer against the coolant flow passageway walks closest to the mold cavity and, thereby, enhance the efficiency of cooling. The small circles shown in the drawings represent vapor bubbles. The ribs 68, 69, 70, 76, 77, 78, therefore, serve to enhance the transfer rate from the heat exchanger or insert inner surfaces using the mechanism of flow tripping established by the ribs. This causes flow separation and reattachment where the liquid flows over the ribs and comes in contact with a valley surface with the eddy serving to recirculate coolant and remove vapor bubbles from the valley and into the main coolant stream. This serves to resist formation of the viscous sublayer which would interfere with efficient heat exchanger operation. This type of flow and the turbulence induced therein resists the vapor bubbles which form at many nucleation sites from coalescing to form an undesired vapor film blanketing the heat exchanger surfaces thereby resulting in poor heat transfer. Such a condition could lead to undesired burn-out. The present system has continuous creation of vapor bubbles which carry with them substantial heat from the heat exchanger surfaces with the bubbles subsequently being swept into the bulk fluid. It will also be appreciated that the eddies not only serve to remove vapor bubbles which have formed as a result of exposure to the heat exchanger surfaces from the same, but they also serve to bring fresh bulk fluid into contact with the hotter surfaces so that new vapor bubbles are formed and swept away. It is also important to note that the system of the present invention will function regardless of the magnitude of angle A of the heat exchanger in that the vapor bubbles will not form and stagnate against some surface whereby a thick vapor film could develop.

The nucleate boiling which occurs through the high heat transfer, which causes the formation of the vapor bubbles by conversion of the liquid into vapor, enhances the thermal efficiency of the system.

Figure 3:
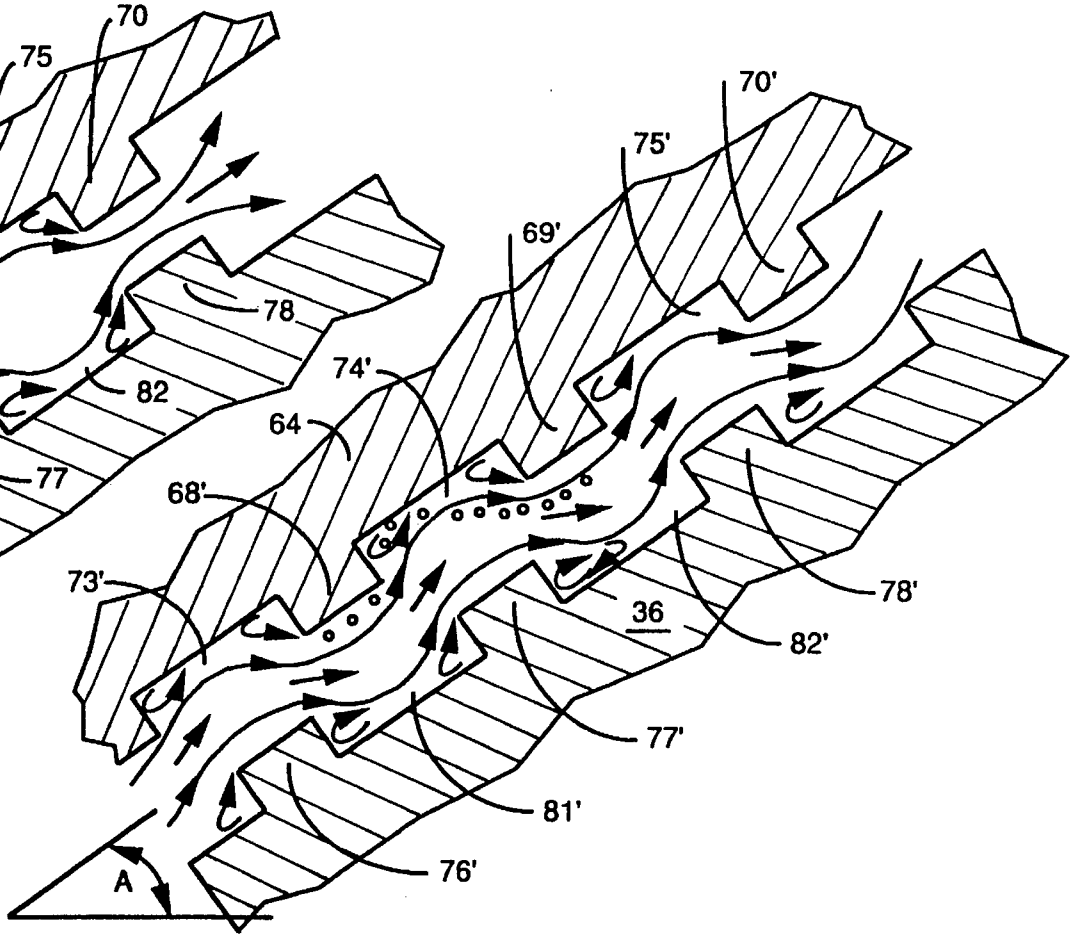
FIG. 3 is a cross-sectional view of a modified form of coolant passageway of the present invention.

Referring to FIG. 3, there is shown a plurality of ribs 68', 69', 70' on the shell 64 having interposed valleys 73', 74', and 75'. The insert core has ribs 76', 77', 78', and associated valleys 81', 82'. In this embodiment, the ribs of one side are axially displaced from the ribs of the other so as to create a staggered relative positioning. This results in the type of flow of the main coolant stream and its associated eddies shown in FIG. 3. One of the advantages of this approach is that an oscillating flow field is created in the coolant flow passageway which, in turn, generates high levels of turbulence at a lower pressure drop through the system. It functions similarly to the embodiment illustrated in FIG. 2 in that vapor bubbles are formed in the recirculating eddies and are delivered to the main flow stream of the coolant. FIGS. 2 and 3 illustrate just a few ribs, but it will be understood that any desired number may be employed depending on rib size and the area to be covered.

If desired, ribs may be produced on only one side of the turbulence inducing passageway, such as on the shell side, which in the case of FIG. 3, would be ribs 68', 69', 70' with the other surface being substantially devoid of turbulence inducing means.

Figure 4:
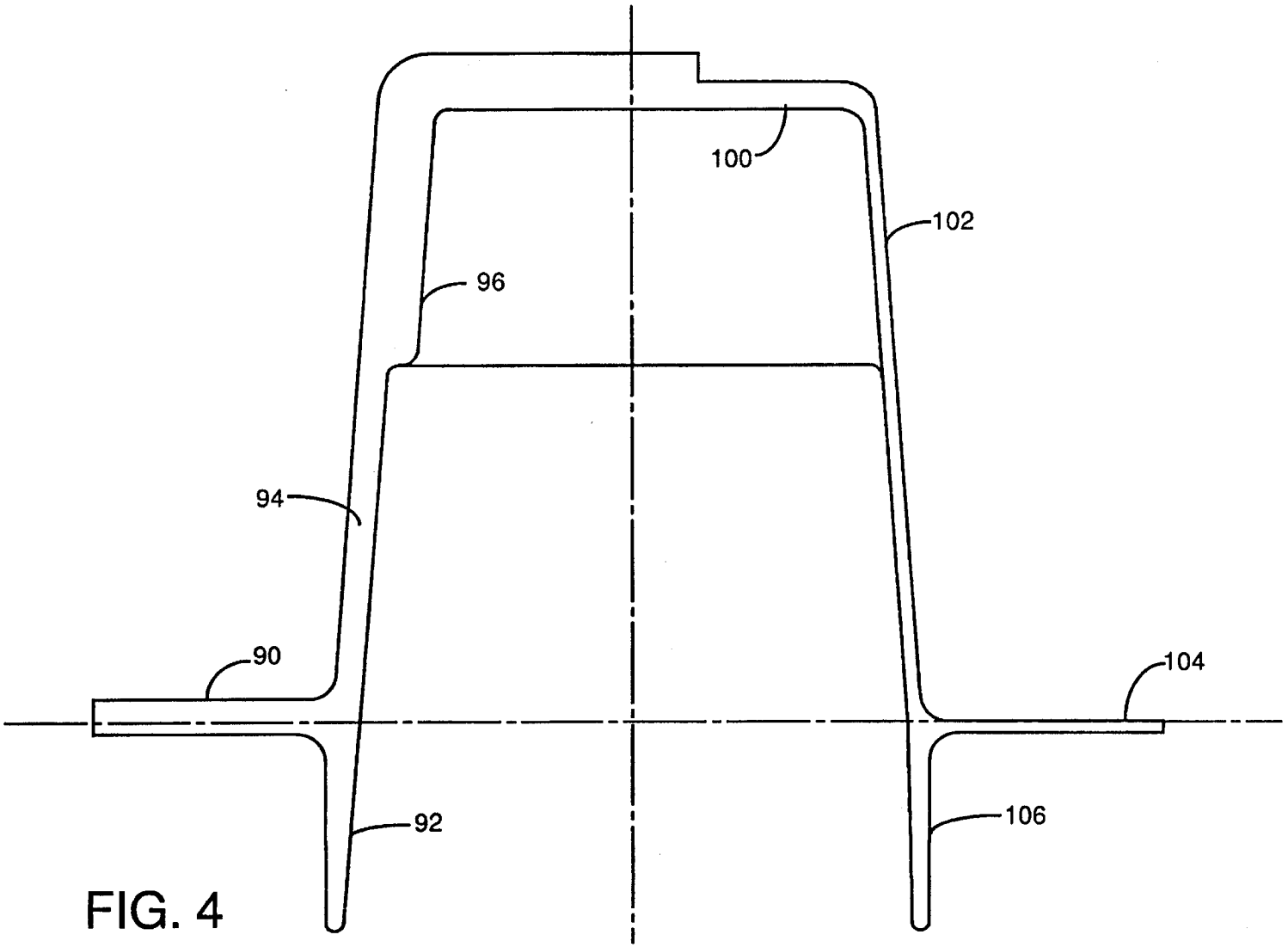
FIG. 4 is an end elevational view of a metal casting which may be made employing the system of the present invention.

FIG. 4 illustrates a form of complex casting for which the present invention is particularly suited. The mold cavity would normally receive metal through gated portion 90 with flow extending into flange portion 92 and reaching other portions of the casting through relatively thin wall 94. It will be noted that wall 96 is generally right angled and substantially thicker than wall 94 with wall 100 being of generally the same thickness as wall 94 and wall 102 being thinner than wall 100. Flange 104 is generally of the same thickness as wall 102 and flange 106 has generally the same configuration as wall 92.

As will be apparent from FIG. 4, molten metal entering gated portion 90 will have to pass through the region of the mold cavity defining wall 94 in order to get to wall 96 and walls 100, 102 and flanges 104, 106 which are downstream therefrom in respect of the direction of flow of molten metal. This casting is a conventionally troublesome complex casting when considered in the context of prior art die casting equipment and procedures. Metal would tend to solidify within wall 94 which is illustrated as being about one-half as thick as wall 96 and this would tend to produce excess shrinkage and excessive porosity within thick wall section 96. In filling the casting cavity with molten metal added pressure is applied to the metal in the mold cavity during the intensification phase in order to feed metal through the interdendritic structure of the solidifying casting. As the casting solidifies, there is a mixture of solidified fractions and liquid fractions called a mushy region. The solid fraction becomes fixed in space, but the liquid portion can be pushed through the solid portion until such time as an upstream thin wall freezes completely. The lack of interdeudritic alloy feed into the thick wall would result in a casting having inferior or unacceptable mechanical properties.

Referring to FIGS. 5 through 8, a detailed description of an insert embodiment will be provided. In this embodiment, the insert consists of an outer shell 110 which, in the form shown, cooperates with and is secured to, as by welding, for example, a pair of insert core members 112, 114. The shell 110 and cores 112, 114 may advantageously be made of steel, such as the type as would be employed in the die casting mold. In the preferred embodiment, the insert will be introduced into a recess in the die such that the surface 118 of the shell 110 facing the mold cavity 120 will define a portion of the mold cavity. In the form shown, an adjacent mold portion 122 cooperates with the insert shell 110 to define the mold cavity portion 120 within which a portion of the casting will be formed. Insert core 112 has a passageway 130 through which coolant liquid in the directions indicated by the arrows. The passageway has an inlet region 134 for introduction of the coolant, an outlet region 136 for discharge of the coolant and an interposed turbulence inducing region 140. In the form illustrated, the passageway 130 is generally U-shaped with the turbulence inducing passageway portion being generally parallel to the mold defining surface 118 of shell 110. Coolant liquid, which may be conveniently be water, oil, a water-alcohol combination or any other suitable material is introduced into the insert through channel 142 and passes through cross-channel 144 to enter passageway portion 134. The coolant is supplied from a suitable reservoir under the influence of a pump. Discharge of coolant from the insert has the coolant flowing from passageway portion 136 through cross-conduit 150 and into channel 152 for return to the reservoir. The reservoir and its associated equipment will generally contain a heat exchanger which serves to reduce the temperature of the coolant exiting the insert before reintroduction into the insert for a further cooling of the casting. The reservoir and pumping means are well known to those skilled in the art and need not be disclosed in detail herein.

Figure 5:
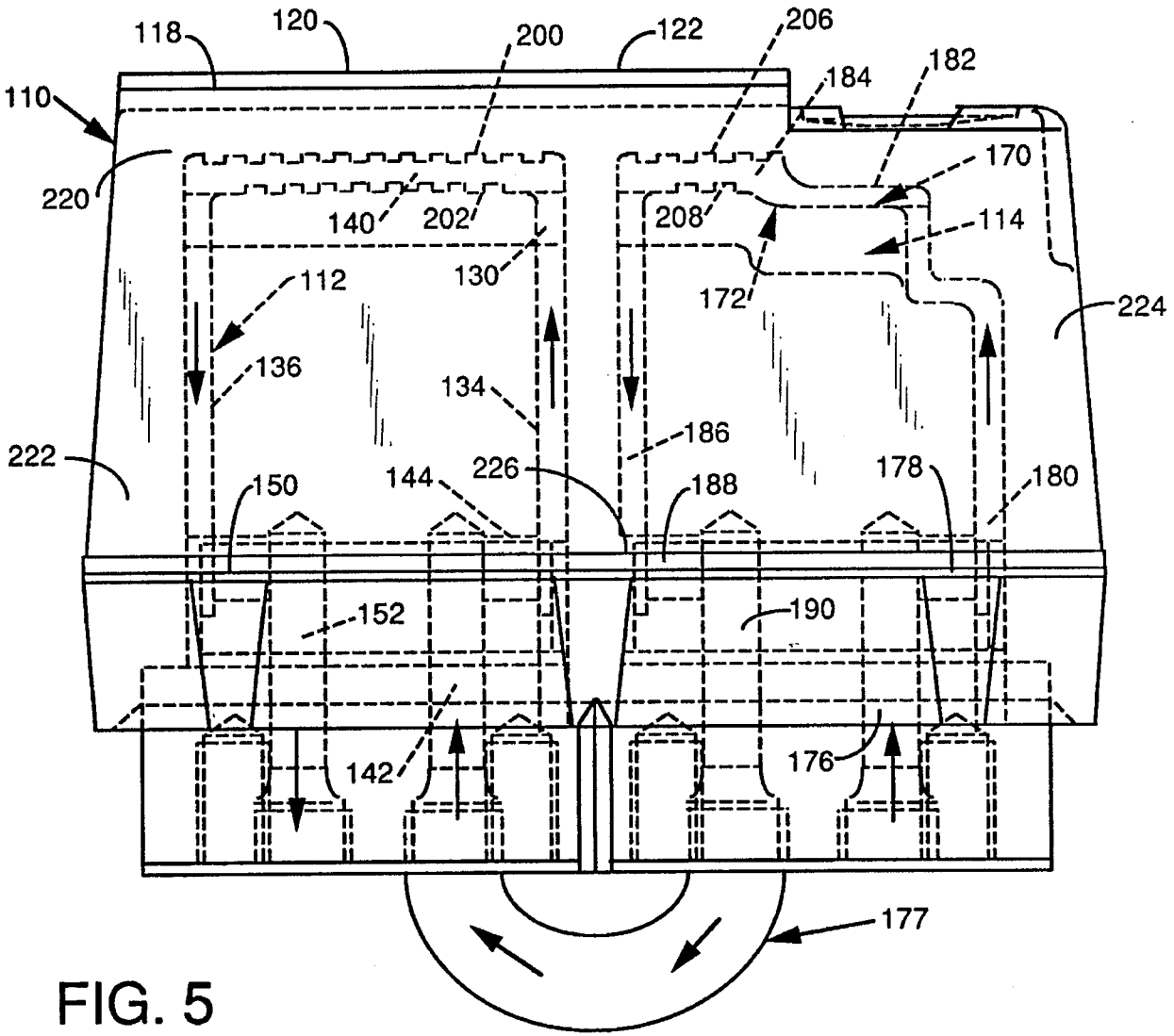
FIG. 5 is an elevational view of an insert of the present invention.
Figure 6:
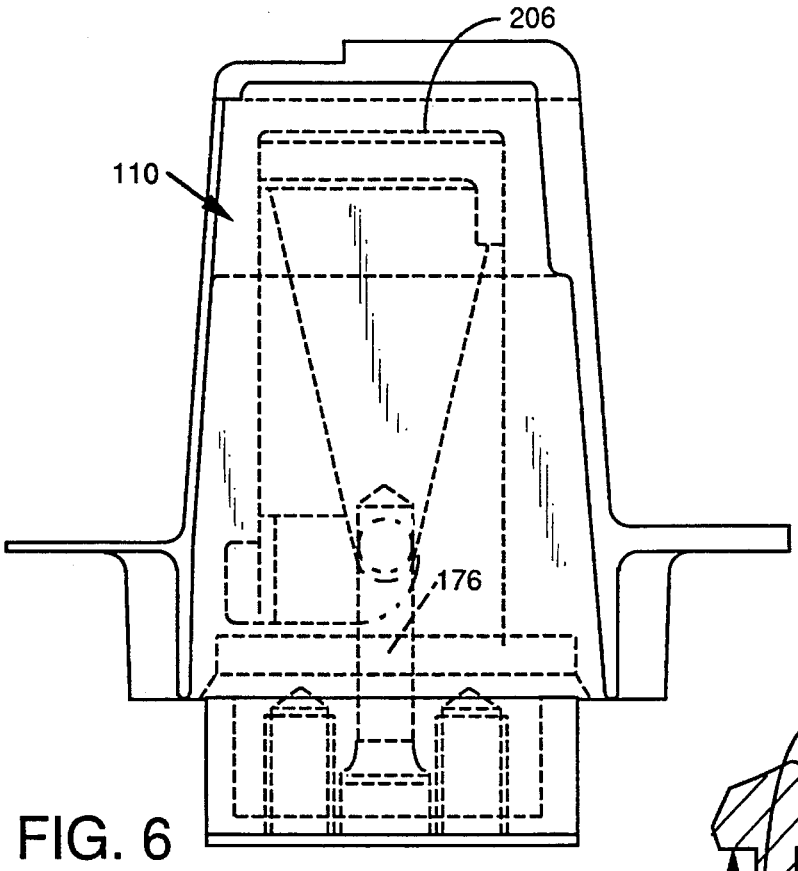
FIG. 6 is a left-hand elevational view of the insert of FIG. 3.

Referring to the right-hand portion of FIG. 5, it is noted that it will be seen that the insert has a second core 170 which cooperates with the shell 110. This portion of the insert defines a passageway 172 for flow of coolant liquid and is generally U-shaped. Cooling fluid passes through channels 176 and 178 into the supply portion 180 of the passageway from which it enters a section 182 within which a portion 184 establishes turbulence in the coolant material which then exits through passageway portion 186, channel 188 and channel 190. The additional holes in FIG. 7, which are not numbered, are bolt holes for fixing the insert in the die.

It will be appreciated that unlike FIG. 1 wherein each insert core cooperates with a separate shell, in FIG. 5, a single shell receives two insert cores.

Within the turbulence creating zones, it is generally preferable to provide mechanical means which, as a matter of fluid mechanics, interfere with the normal flow of coolant through passageways 130, 172. The objective is to create sufficient turbulence in the coolant flow as to effect rapid and efficient heat withdrawal from the molten metal in the region adjacent to the die insert so as to provide a high coefficient of convective heat transfer and to operate within the nucleate boiling regime.

Figure 8:
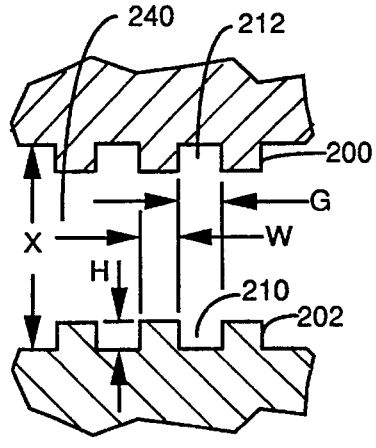
FIG. 8 is a detailed illustration showing a portion of the turbulence inducing means of FIG. 5.
Figure 7:
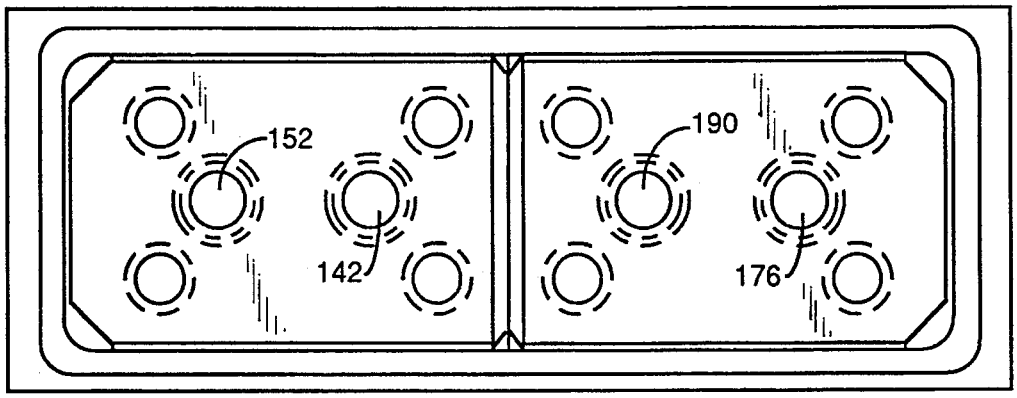
FIG. 7 is a bottom plan view of the insert of FIG. 3.

Referring to FIGS. 5 and 8, it will be seen that the turbulence inducing portion 140 of passageway 130 has a plurality of integrally formed upper ribs 200 cooperating with a plurality of elongated ribs 202, preferably of the same size, each of which is oriented generally perpendicular to the path of flow of the cooling fluid through turbulence inducing passageway portion 140. Similarly, upper and lower ribs 206 and 208 are disposed in turbulence inducing passageway 184. In another embodiment of the invention, if desired, solely upper ribs 200, 206 within the turbulence inducing portions 140, 184 of the passageway, but it is preferred for maximum cooling efficiency to employ both upper ribs 200, 206 and lower ribs 202, 208.

As shown in the detail of FIG. 8, in the preferred practice of the invention, the gap between adjacent ribs "X" is preferably about 0.200 to 0.625 inch. The ribs have a width "W" of about 0.050 to 0.200 inch the ribs have a height "h" of about 0.025 to 0.100 inch. The valleys, such as valleys 210, 212 between adjacent ribs preferably have a height "H" equal to the rib height and a width "G" of about 0.050 and 0.600 inch.

Figure 9:
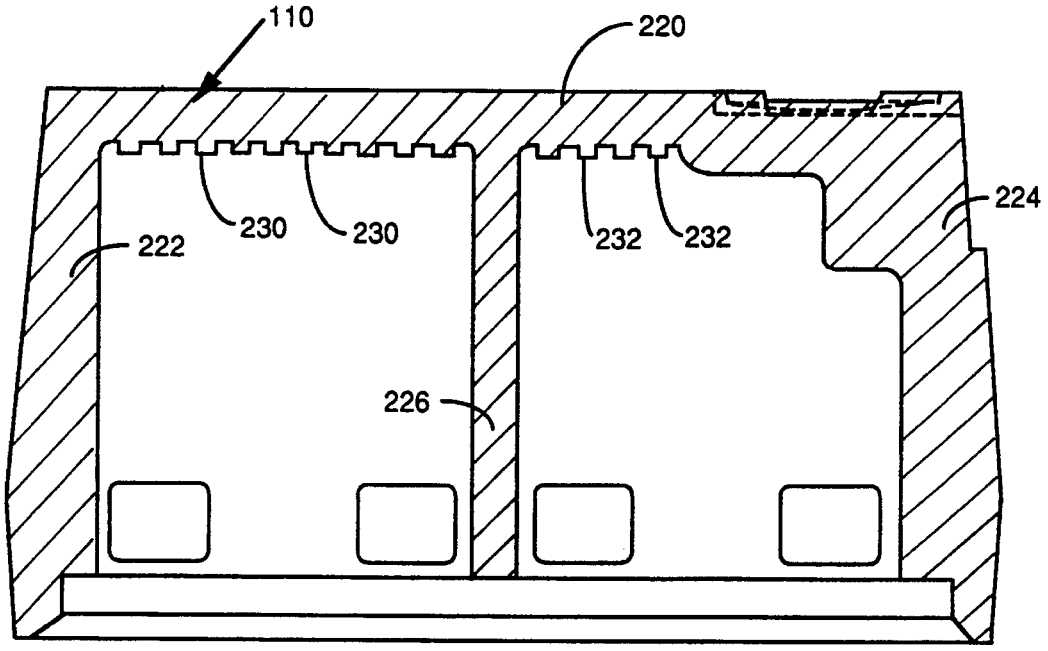
FIG. 9 is an elevational view of the shell portion of an insert of the present invention.
Figure 10:
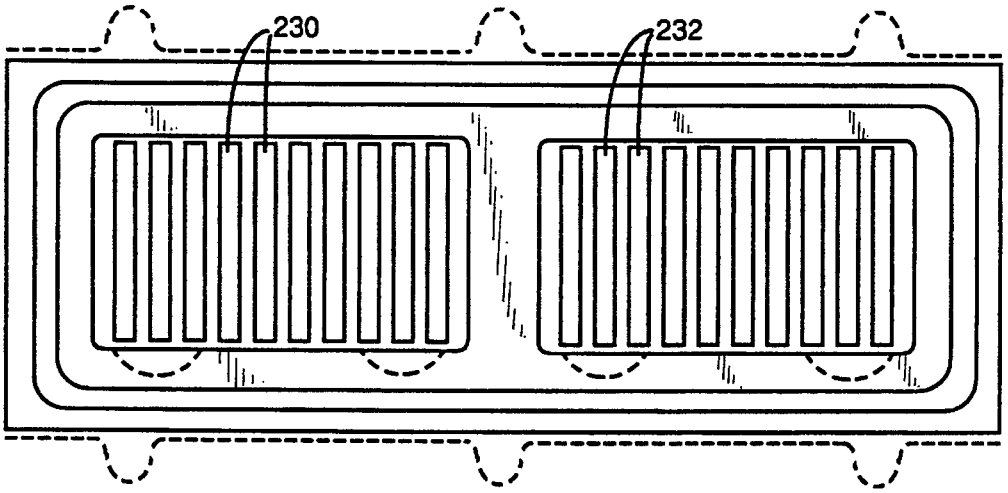
FIG. 10 is a bottom plan view of the shell of the present invention.

As shown in FIGS. 5, 9 and 10, the steel shell 110 has an upper portion 220 which is adjacent to the mold cavity, a depending arm 222, which is adjacent to insert 112, a depending arm 224, which is adjacent to insert 114, and an intermediate depending portion 226 which is interposed between inserts 112 and 114. In a preferred embodiment, both of the insert cores 112, 114 will be received in intimate physical contact with the insert shell 110 so as to facilitate firm mechanical interengagement therebetween and securement to each other by suitable means, such as welding, for example. The lower surface of shell 110 has a first plurality of downwardly projecting elongated ribs 230 and a second plurality of downwardly projecting elongated ribs 232 which, respectively, are in either relative aligned or staggered position with respect to ribs 200, 206 of the upper surfaces of insert cores 112, 114. In this manner, the shell 110 and insert cores 112, 114 facilitate efficient thermal transfer to the coolant fluid. In this embodiment, a single shell cooperates with two insert cores. If desired, a separate shell may be provided for each insert core.

Figure 12:
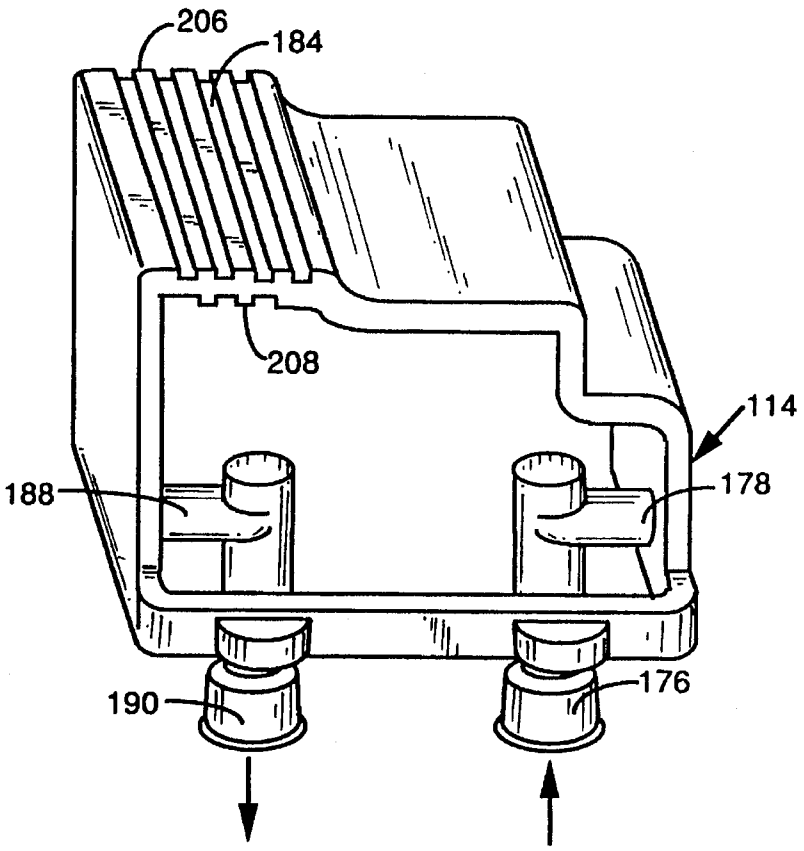
FIGS. 11 and 12 illustrate perspective views of the heat exchanger insert showing the arrangement of the fluid flow passageway created by the shell and insert core from the mold cavity side.
Figure 11:
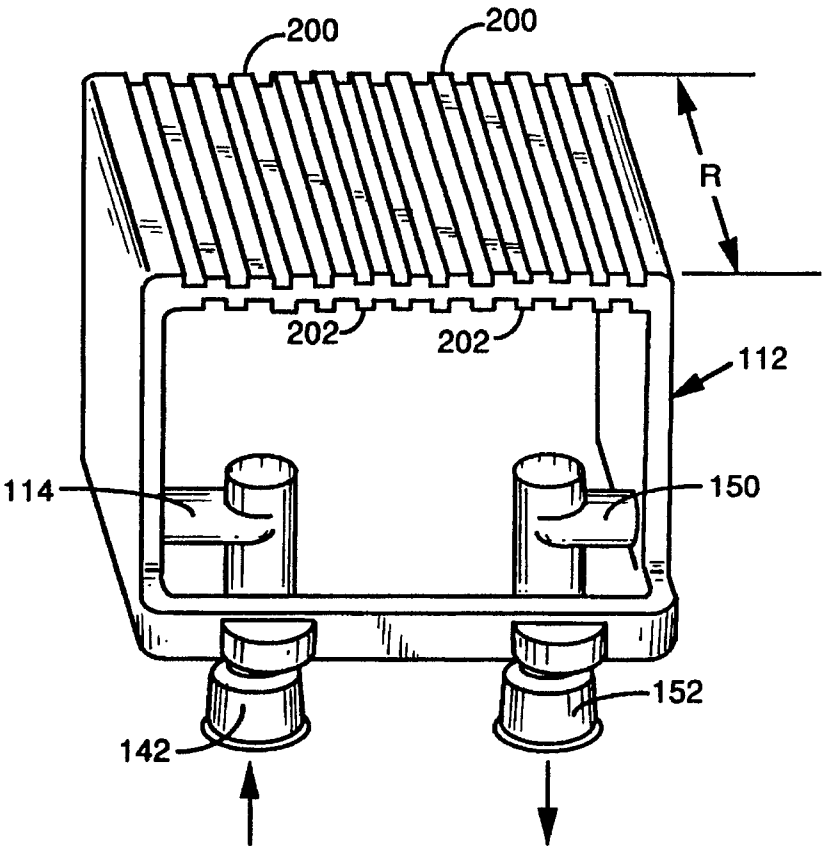

Referring to FIGS. 11 and 12, there are shown perspective views of the inserts 112, 114. The flow passageways of inserts 112, 114, as illustrated in FIGS. 11 and 12, are defined by securing the shell having, respectively, ribs 200, 206 to the insert cores having, respectively, ribs 202, 208 and the associated entry and discharge portions of the coolant liquid passageways which the shells and inner cores define. It will be appreciated that the length of ribs R and the proportions of adjacent valley or groove portions will vary depending upon the nature of the product being molded, and the extent of the mold portion being cooled by the insert. "R" will generally be within the range of about 0.50 to 100 inches and, preferably, 0.50 to 10 inches. It will be appreciated that the rate of flow of the coolant will depend a great deal on the nature of the article being cast and the specific region which is being cooled by the insert of the present invention.

For most uses, the coolant flow rate will be in the range of 0.1 to 2 gallons per minute and preferably about 1 to 2 gallons per minute. In a preferred practice of the invention, the entry temperature of the coolant water will be at ambient room temperature, preferably about 70° to 90° F.

The system of the present invention has been to produce highly desirable low dendrite arm spacing which may be on the order of about 5 to 10 microns.

Figure 13:
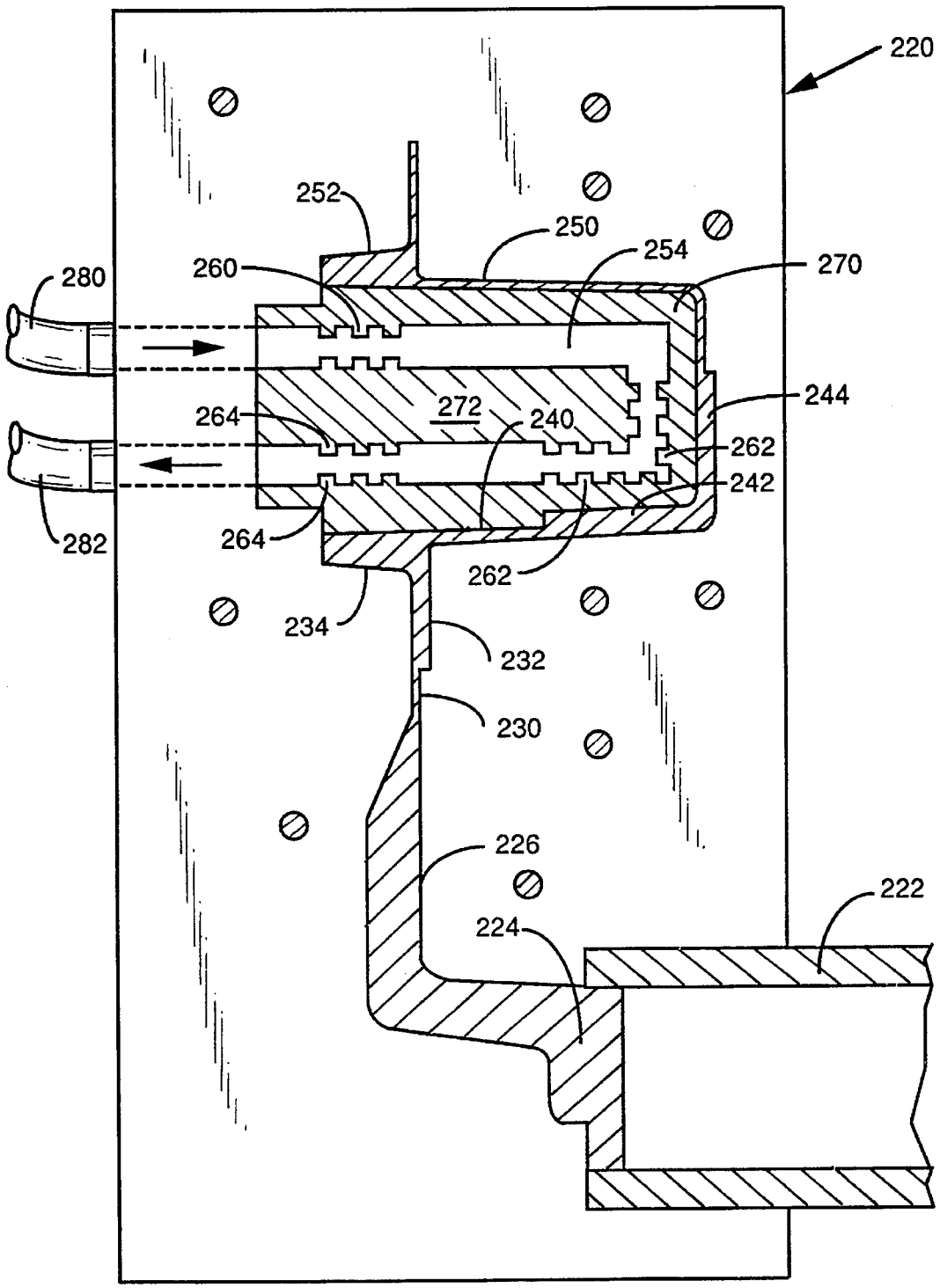
FIG. 13 is a cross-sectional illustration of a single heat exchanger insert and die of the present invention.

Referring to FIG. 13, there is shown a casting die 220 with a single insert of the present invention. The casting die has a shot sleeve 222 with a sprue 224 and runner 226 and gate 230. The casting has a thin base wall 232, an adjacent thick flange 234, an adjacent thin wall 240 and a right angled thick wall 242, 244 followed by a thin wall 250 and an adjacent thick wall 252. This insert has a coolant fluid passageway 254 having three turbulence inducing regions 260, 262, 264 each adjacent, respectively, thick walls 252, 242, 244 and. 234. In the form shown, the ribs are on both the shell 270 and the insert core 272. Coolant supply line 280 and coolant discharge line 282 are operatively associated with the coolant passageway.

EXAMPLES

In order to confirm the effectiveness of the system of the present invention, tests were performed. With reference to FIG. 4, a casting having the general configuration, as shown therein with a gated portion 90 providing for introduction of the molten metal, was employed. Water was employed as a coolant with the water outlet temperature reaching a maximum of 242° F. which is above the boiling point of water. This outlet temperature provided an indication that the insert was operated in the nucleate boiling regime. The water coolant flow rate was 1.5 gallons per minute. Comparing the shrinkage porosity for wall 94 of FIG. 4 with wall 96, with the former having a thickness of 4 mm and the latter having a thickness of 8 mm, and being downstream in respect of the direction of metal flow with respect to wall 94, the cast shrinkage porosities for low iron content aluminum alloy, i.e., about 0.10 percent Fe in Alcoa aluminum alloy C119 was 0.39 percent and the shrink porosity in thicker wall 96 employing the insert of the present invention, was 0.38 percent. This is a very low level of porosity. As a further test of the system, the two sections of wall 96 were tested. The insert of the present invention had ribs on the shell, and also on the insert core. An adjacent portion of the identical casting had the two sections of wall 96 cooled by conventional prior art cooling through ⅝ inch standard cooling lines. In this side-by-side comparison of the two systems, while the insert of the present invention produced a shrinkage porosity of 0.38 percent in wall 96, the prior art system produced a wail shrinkage of 0.62 percent. The-side-by-side comparison, therefore, resulted in the cooling system of the present invention in the identical environment producing 39 percent less shrinkage porosity than the prior art system, The two subunits, one of the invention and the one of the prior art employed the same water source interconnected with the prior art portion receiving coolant first. In addition to lower porosity of the casting produced by the present invention, x-ray tests confirmed the superiority of the present invention. The casting portion cooled by the present invention produced no x-ray detectable porosity. It received a level 1 x-ray rating, while the prior art ⅝ inch cooling lines had x-ray detectable shrinkage levels of 1.5 to 3.5. The higher the number, the greater the pore size and pore population. The level 1 rating of the casting cooled by the present invention corresponds to pore sizes smaller than 100 microns.

In a second series of tests employing low iron content Alcoa aluminum alloy C119 and the casting profile of FIG. 4, the rate of coolant flow was altered to determine the affect of the cooling regime by comparing convective versus nucleate boiling regimes on shrinkage levels. The coolant flow rate varied from 0.10 gallons per minute to 1.22 gallons per minute. It was found that the wall section 96, which was cooled by the insert of the present invention exhibited 0.30 percent shrinkage porosity and the adjacent section of wall 96, which was cooled by the prior art, ⅝ inch standard cooling line exhibited 0.52 percent shrinkage porosity. This resulted in 42 percent less shrinkage porosity for the segment of wall 96 cooled by the insert of the present invention. It was found that altering the volumetric flow of the water coolant within this range did not produce a significant difference in shrinkage porosity levels as measured by the Archimedes density method.

In measuring the porosity employing X-ray ratings of wall 96 of FIG. 4 which was 8 mm thick, with a level 1 rating meaning no X-ray detectable porosity was visualized during the testing up through level 8 which corresponds to large shrinkage holes, it was determined that the insert of the present invention produced lower X-ray ratings than the prior art ⅝ inch circular coolant channel approach and in two of the five tests employing circulating water the castings of the present invention received a level 1 rating.

It will be appreciated, therefore, that the present invention has provided an efficient means for employing die casting inserts to facilitate elimination of excessive porosity in metal castings and particularly portions of complex castings. This is facilitated through the turbulence created eddies within the portion of the coolant passageway closest to the mold cavity. The turbulence is such as to enhance the rate of heat removal while remaining within the convective and nucleate boiling regimes. The present system achieves localized directional solidification and, thereby, enhances the efficiency of casting particularly where complex parts are involved.

While for purposes of illustration, examples of ribs providing the turbulence inducing means have been employed, it will be appreciated that other means of accomplishing the same objective such as finned heat exchanger elements, for example, disposed within the turbulence inducing portion, may be employed in lieu thereof.

While for purposes of simplicity of disclosure, a pull-down insert having a single shell with two cores has been illustrated and described, it will be appreciated that various numbers and combinations of shells and cores may be employed in order to achieve the benefits of localized directional solidification of the present invention. Also, an insert may have more than one turbulence inducing region.

While the invention is particularly suited to die casting of aluminum, it may be employed with other types of castings and other metals, such as zinc and steel, for example, so long as appropriate mold and insert materials well know to those skilled in the art are used.

Reference herein to "upper" and "lower" or similar directional references are employed solely for simplicity of disclosure and are not limitations on the invention.

Whereas particular embodiments of the present invention have been described above herein, for purposes of illustration, it will be appreciated by those skilled in the art that numerous variations of the details may be made without departing from the invention as described in the appended claims.

What is claimed is:

1. Apparatus for casting a metal article comprising a die casting mold having a mold cavity and a coolant receiving insert movably disposed within said casting mold having a portion adjacent to said mold cavity, said insert having a mold cavity defining surface which defines a portion of said cavity, said insert having a coolant flow passageway for flow of coolant therethrough, means for introducing molten metal into said mold cavity, and turbulence inducing means disposed within said coolant flow passageway adjacent to said mold cavity in order to remove coolant vapor from said coolant flow passageway and resist undesired porosity in the section of said cast metal article that is adjacent to said insert.

2. The casting apparatus of claim 1 including said insert having an outer shell and an insert core which cooperates therewith, and said coolant turbulence creating means disposed in a portion of said passageway extending generally parallel to said cavity defining surface.

3. The casting apparatus of claim 2 including a plurality of said inserts disposed within said mold.

4. The casting apparatus of claim 2 including said coolant flow passageway having more than one zone of turbulence inducing means.

5. The casting apparatus of claim 2 including said insert having a single shell and more than one insert core.

6. The casting apparatus of claim 2 including said insert being disposed within said mold cavity adjacent to a portion of the cavity which is thicker than at least some other portions of said cavity.

7. The casting apparatus of claim 6 including said coolant passageway having a coolant introduction portion in communication with said coolant turbulence inducing passageway portion, and a coolant discharge portion communicating with said coolant turbulence creating portion.

8. The casting apparatus of claim 6 including said casting apparatus being die casting apparatus.

9. The casting apparatus of claim 2 including said turbulence inducing means including a plurality of elongated generally parallel ribs on at least one of the upper passageway surface and the lower surface of said coolant flow passageway.

10. The casting apparatus of claim 9 including said ribs being oriented in a direction generally perpendicular to the turbulence inducing passageway portion of said passageway.

11. The casting apparatus of claim 10 including said turbulence inducing means having said ribs on both said upper and lower passageway surfaces.

12. The casting apparatus of claim 11 including said upper passageway surface ribs being staggered with respect to said lower passageway surface ribs.

13. The casting apparatus of claim 11 including said upper passageway surface ribs being in general alignment with said lower passageway surface ribs in order to define alternating enlargements and restrictions in said turbulence inducing portion of said passageway.

14. The casting apparatus of claim 13 including said ribs having a height of about 0.025 to 0.100 inch and a width of about 0.05 to 0.200 inch.

15. The casting apparatus of claim 14 including the minimum spacing between said upper passageway surface ribs and said lower passageway surface ribs being about 0.200 to 0.625 inch.

16. A method for casting a metal article comprising providing a die casting mold having a mold cavity and a coolant receiving insert movably disposed within said die casting mold having a portion adjacent to said mold cavity with said insert having an insert coolant flow passageway for flow of coolant therethrough and coolant turbulence inducing means disposed within a turbulence inducing passageway portion of said passageway, employing a cavity defining surface of said insert to define a portion of said mold cavity, introducing molten metal into said cavity, establishing coolant flow within said insert passageway, boiling a portion of said coolant to form vapor, and creating turbulence in said coolant flow within said insert portion adjacent to said mold cavity to remove said vapor from said insert portion and to resist the formation of undesired porosity in the section of said cast metal article that is adjacent to said insert.

17. The method of die casting of claim 16 including employing a plurality of said inserts.

18. The method of die casting of claim 16 including employing as a said insert a shell having more than one insert core.

19. The method of die casting of claim 16 including employing in said insert an outer shell and an insert core which cooperates with said shell to define said passageway, and establishing said coolant turbulence in a portion of said passageway extending generally parallel to said cavity defining surface.

20. The method of die casting of claim 19 including establishing coolant flow in said turbulence inducing passageway portion at a rate of about 0.10 to 2.00 gal/min.

21. The method of die casting of claim 19 including employing a said insert having a said passageway with a coolant introduction portion, a said turbulence inducing passageway portion to receive coolant therefrom, and a coolant discharge portion to receive coolant from said turbulence inducing portion and discharge the same.

22. The method of die casting of claim 21 including creating eddy currents which remove bubbles from the valleys between said ribs and deliver them to the coolant stream.

23. The method of die casting of claim 21 including employing more than one turbulence inducing passageway portion.

24. The method of casting of claim 19 including employing as said turbulence inducing means a plurality of elongated generally parallel ribs on at least one of the upper surface and the lower surface of turbulence inducing passageway portion.

25. The method of casting of claim 24 including orienting said ribs in a direction generally perpendicular to the direction of coolant flow through said turbulence inducing passageway portion.

26. The method of casting of claim 25 including employing said ribs on both said upper and lower surfaces.

27. The method of die casting of claim 26 including establishing said ribs on said upper surface in relative staggered relationship with respect to said ribs on said lower surface.

28. The method of casting of claim 26 including employing said method in making a die casting.

29. The method of die casting of claim 28 including establishing alternating restrictions and enlargements in said turbulence inducing passageway portion by positioning said ribs on said upper surface in general alignment with said ribs on said lower surfaces.

30. The method of die casting of claim 29 including employing ribs having a height of about 0.025 to 0.100 inch and a width of about 0.050 to 0.200 inch.

31. The method of die casting of claim 30 including establishing minimum spacing between said ribs on said upper surface and said ribs on said lower surface of about 0.050 to 0.600 inch.

32. The method of die casting of claim 28 including employing said insert adjacent a portion of said mold cavity producing a thicker casting section than at least some other portions of said mold cavity.

33. The method of die casting of claim 32 including employing said method to cast an aluminum article.

34. The method of die casting of claim 32 including employing said insert adjacent to a thicker casting section which is disposed downstream in respect of molten metal flow from a thinner section.

35. A casting mold insert in a die casting apparatus comprising a shell member adapted to have a portion positioned adjacent to a mold cavity, an insert core having a passageway for passage of cooling fluid therethrough, said passage having a turbulence inducing passageway portion disposed adjacent to the shell portion which is structured to be adjacent to the mold cavity, said turbulence inducing passageway portion including means structured to remove coolant vapor from said passageway, and said insert core passageway having coolant inlet means and coolant outlet means disposed on opposite sides of and in communication with said turbulence inducing passageway portion.

36. The die casting mold insert of claim 35 including said turbulence inducing means including mechanical means extending into the portion of said turbulence inducing passageway portion to at least partially restrict flow of coolant therethrough and thereby establish turbulence.

37. The die casting mold insert of claim 36 including said turbulence inducing means being fin means.

38. The die casting mold insert of claim 36 including said turbulence inducing means including a plurality of elongated ribs oriented generally transversely to the direction of coolant flow through said turbulence inducing portion of said passageway.

39. The die casting mold insert of claim 38 including said shell member being adapted to have a portion positioned adjacent to a die casting mold cavity.

40. The die casting mold insert of claim 38 including said ribs having a rib height of about 0.025 to 0.100 inch and a rib width of about 0.050 to 0.200 inch.

41. The die casting mold insert of claim 40 including said rib means being formed in at least one of the upper surface and the lower surface of said turbulence inducing passageway portion.

42. The die casting mold insert of claim 41 including said rib means projecting inwardly into said turbulence inducing portion of said passageway and being present on both said upper mid lower surfaces within said turbulence inducing portion.

43. The casting mold of claim 42 including said ribs on said upper passageway surface being generally staggered with respect to said ribs on said lower passageway surface.

44. The die casting mold insert of claim 42 including said ribs on said upper passageway surface being generally aligned with said ribs on the lower passageway surface.

45. The die casting mold insert of claim 44 including the spacing between a pair of said aligned ribs being about 0.200 to 0.625 inch.

* * * * *

UNITED STATES PATENT AND TRADEMARK OFFICE

CERTIFICATE OF CORRECTION

PATENT NO. : 5,522,448

DATED : June 4, 1996

INVENTOR(S) : Jamal Righi

It is certified that error appears in the above-indentified patent and that said Letters Patent is hereby corrected as shown below:

| | |
|---|---|
| Col. 10, claim 1, line 3 | Delete "movably" and insert --removably-- therefor |
| Col. 12, claim 16, line 3 | Delete "movably" and insert --removably-- therefor |
| Col. 14, claim 42, line 4 | Delete "mid" and insert --and-- therefor |

Signed and Sealed this

Fifteenth Day of April, 1997

Bruce Lehman

*Attest:*

BRUCE LEHMAN

*Attesting Officer*

*Commissioner of Patents and Trademarks*